US008796961B2

(12) United States Patent
Kobayashi et al.

(10) Patent No.: US 8,796,961 B2
(45) Date of Patent: Aug. 5, 2014

(54) COMPLEX JOYSTICK CONTROL SYSTEM AND METHOD

(76) Inventors: Ken Kobayashi, Webster, TX (US); Herbert S. Kobayashi, Webster, TX (US)

( * ) Notice: Subject to any disclaimer, the term of this patent is extended or adjusted under 35 U.S.C. 154(b) by 717 days.

(21) Appl. No.: 13/107,930

(22) Filed: May 15, 2011

(65) Prior Publication Data

US 2011/0226078 A1 Sep. 22, 2011

Related U.S. Application Data

(63) Continuation-in-part of application No. 12/506,478, filed on Jul. 21, 2009, now Pat. No. 8,427,084.

(51) Int. Cl.

| | |
|---|---|
| ***H02P 1/00*** | (2006.01) |
| ***H02P 3/00*** | (2006.01) |
| ***H02P 3/20*** | (2006.01) |
| ***E02F 9/20*** | (2006.01) |

(52) U.S. Cl.

CPC ..... *E02F 9/2008* (2013.01); *H01H 2217/04* (2013.01)

USPC ..... 318/257

(58) Field of Classification Search

CPC ..... E02F 3/435

USPC ..... 318/257

See application file for complete search history.

(56) References Cited

U.S. PATENT DOCUMENTS

| | | | | |
|---|---|---|---|---|
| 3,047,167 | A | | 7/1962 | Rose |
| 3,263,824 | A | | 8/1966 | Jones |
| 3,414,136 | A | | 12/1968 | Moore |
| 3,664,517 | A | | 5/1972 | Germond |
| 4,046,262 | A | | 9/1977 | Vykukal |
| 5,019,761 | A | * | 5/1991 | Kraft ..... 318/568.11 |
| 5,249,140 | A | | 9/1993 | Kessler |
| 6,140,787 | A | * | 10/2000 | Lokhorst et al. ..... 318/568.18 |
| 6,477,914 | B1 | * | 11/2002 | Krieger ..... 74/491 |
| 6,850,817 | B1 | | 2/2005 | Green |
| 7,070,571 | B2 | | 7/2006 | Kramer |
| 7,421,193 | B2 | | 9/2008 | Kobayashi |
| 7,474,296 | B2 | | 1/2009 | Obermeyer |
| 7,641,461 | B2 | | 1/2010 | Khoshnevis |
| 7,692,667 | B2 | | 4/2010 | Nguyen |
| 7,696,978 | B2 | | 4/2010 | Mallett |
| 7,752,779 | B2 | | 7/2010 | Schoenmaker |
| 7,788,476 | B2 | | 8/2010 | McNutt |

* cited by examiner

*Primary Examiner* — Erick Glass

(74) *Attorney, Agent, or Firm* — Kenneth L. Nash

(57) ABSTRACT

A complex joystick system master unit embodiment utilizes joystick segments and joystick joints arranged in a particular order with a slave unit arranged in a similar order. A sample master unit with three joystick segments has segment lengths that provide a relative ratio of lengths between themselves. The slave unit articulated arm utilizes controlled segments and articulated arm joints arranged in the same order and having the same relative ratio of lengths between themselves. Articulated arm electronic angle sensors and joystick segment angle sensors produce signal that are applied to a plurality of servos. The servos control movement of the articulated arm so that said respective relative angular articulated arm positions of the articulated arm controlled segments match those of the complex joystick segments.

20 Claims, 12 Drawing Sheets

COMPLEX JOYSTICK CONTROL SYSTEM AND METHOD

This application is a continuation-in-part application of U.S. application Ser. No. 12/506,478, filed Jul. 21, 2009 now U.S. Pat. No. 8,427,084, which is hereby incorporated by reference.

BACKGROUND OF THE INVENTION

1. Field of the Invention

The present invention relates generally to joystick control systems and, more particularly, to a complex joystick system to operate multiple jointed equipment such as, for example only, the articulated arm of a back hoe, catching moving objects or throwing, snaking or underground movement, and the like as discussed hereinafter.

2. Description of the Background

Controls for equipment such as back hoes or other construction equipment may comprise multiple cylinders and valves. For example, a back hoe may utilize four cylinders controlled by four way valves. Other types of equipment may comprise more complicated cylinder and multiple way valve configurations.

Prior art controls for this type of equipment may typically comprise rows of levers to control the valves and cylinders. To operate the equipment requires a considerable learning curve to develop the necessary skill. Even a skillful operator may have difficulty immediately positioning the end of the back hoe arm at a particular point in space due to the need for simultaneous operation of multiple levers in different rows.

U.S. Pat. No. 3,263,824 to L. Jones et al. discloses a servo controlled manipulator device comprising a manipulator hand having at least one joint therein, a control glove having at least one finger portion therein, a first servo means for rotatably positioning the joint of said manipulator hand in accordance with the position of said finger portion of said glove, said servo means including means for pneumatically actuating the joint of said manipulator hand, the control glove having an inflatable bladder extending along the longitudinal axis of said finger portion, and said servo means for inflating said bladder in accordance with the difference between the rotatable position of the joint of said manipulator hand and the rotatable position of said finger portion.

U.S. Pat. No. 3,414,136 to J. R. Moore et al. discloses a system for positioning an underwater manipulator arm to correspond with the position of an analog arm. The flow rate and pressure of the fluid transmitted to the hydraulic actuators used to move the manipulator arm are measured by transducers. The output of the transducers is integrated or otherwise processed by conversion circuits to produce a signal, indicative of the position of the manipulator, which signal is compared with another signal indicative of the analog arm position. An error signal is produced which appropriately actuates valves controlling the fluid flow to the hydraulic actuators, thereby causing the manipulator arm to move to the desired position. Rate damping is provided to the analog arm to simulate the viscous damping experienced by the manipulator during motion in the viscous underwater medium.

U.S. Pat. No. 3,664,517 to Germond et al., issued May 23, 1972, discloses an articulated master-slave manipulator comprises a master assembly and a slave assembly articulated to opposite ends of a tube extending through a wall. The slave assembly comprises a first segment and a second segment which are disposed in that order from the tube which extends through the wall, whereas the master assembly comprises, from its articulation to the tube, a top second half-segment which drives the slave-assembly second segment, a first segment which drives the slave assembly first-segment, and a bottom second half-segment, parallel to the top second half-segments.

U.S. Pat. No. 4,046,262 to Vykukal et al., issued Sep. 6, 1977 provides an anthropomorphic master/slave manipulator system including master arm apparatus including a plurality of master tubular articulated portions which are coaxially adjacent one another and relatively rotatable, master transducing apparatus responsive to the relative rotation of the adjacent tubular portions and operative to provide a driving signal, slave arm apparatus including a plurality of slave tubular portions corresponding to those portions of the master arm apparatus, the slave tubular portions being coaxially adjacent one another and relatively rotatable, slave transducing apparatus responsive to the driving signal and operative to drivingly rotate the slave tubular portions through an angle that corresponds to the relative rotation of the corresponding master arm tubular portions, and a communication link between the master transducing apparatus and the slave transducing apparatus for applying the driving signal to the slave transducer.

It would be desirable to provide a more intuitive system and method for controlling complicated equipment and/or which allows increased capabilities and performance of more difficult tasks. Consequently, there remains a long felt need for an improved complex joy stick control system. Those skilled in the art have long sought and will appreciate the present invention which addresses these and other problems which increase the ease of performing old tasks as well as performing new and more difficult tasks.

SUMMARY OF THE INVENTION

It is an object of the present invention to provide an improved equipment control utilizing a complex joystick.

It is another object of the present invention to provide an intuitive joystick to more easily and quickly operate a wide range of equipment.

These and other objects, features, and advantages of the present invention will become apparent from the drawings, the descriptions given herein, and the appended claims. However, it will be understood that above-listed objectives and/or advantages of the invention are intended only as an aid in quickly understanding aspects of the invention, are not intended to limit the invention in any way, and therefore do not form a comprehensive or restrictive list of objectives, and/or features, and/or advantages.

Accordingly, in one embodiment, the present invention provides a complex joystick control system, which may comprise a complex joystick with n number of joystick segments and corresponding numbers joystick joints. In one possible embodiment, at least three joystick segments and at least four joystick joints might be utilized. The joystick segments may comprise a plurality of joystick elongated segment with lengths that have a relative ratio of lengths between themselves. In other words, the ratio of lengths might be 1; 1.2; 1.0 where each unit has a length of 5 inches or the lengths being 5, 6, and 6 inches. The joystick joints permit movement of an end of the complex joystick in each of x, y, and z directions with respect to a first fixed position. The joystick may or may not be mounted to a support or the like. At least four electronic joystick angle sensors are positioned at the corresponding four joints which produce control signals based on respective relative angular joystick positions of the three joystick segments with respect to each other and the first fixed position. The angle sensors may be of various types.

An articulated arm may comprise any number n of controlled segments and a corresponding number n or n+1 or n−1 of joystick joints, depending on the construction. In one simple embodiment the articulated arm might comprise at least three controlled segments and at least four articulated arm joints, which correspond to the three joystick segments and the four joystick joints. In other words, the order and arrangement is the same. The three controlled segments may comprise a plurality of lengths having the relative same relative ratio of lengths between themselves as does the complex joystick. For example, with a unit length of 10 feet, using the same ratio of lengths, the lengths may be 10 feet, 12 feet, and 10 feet.

The four articulated arm joints permit movement of an end of the articulated arm in each of x, y, and z directions rather than simply planar x, y directions with respect to a second fixed position. At least four articulated arm electronic angle sensors may be positioned at the four joints or elsewhere on the arm segments which produce control signals based on respective relative angular articulated arm positions of the at least three controlled segments with respect to each other and the second fixed position. Various types of angle sensors could be used.

At least four servos receive signals from respective pairs of the four electronic joystick angle sensors and the four articulated arm electronic angle sensors. The four servos operate to control movement of the articulated arm so that the respective relative angular articulated arm positions of the controlled segments match those of the relative angular joystick positions of the three joystick segments. Because the angles are the same and the lengths similar, the profile or positions of the articulated arm segments will now be the same as that of the complex joystick segments.

In one embodiment, the four joystick joints comprise hinged joints. The hinged joints may include at least one joint between a first pair of the joystick segments wherein the first pair of the joystick segments are constrained to move within a first plane relative to each other. In other words, the segments might move in x, y directions (or some other direction) to describe a planar surface of movement. At least one joint between another pair of the joystick segments that is constrained to move within a second plane relative to each other wherein the first plane and the second plane are oriented with an angular spacing therebetween, e.g., the segments might move in the y, z directions.

In one embodiment, the first plane and the second plane may be orthogonal with respect to each other.

The four joystick joints may comprise at least one joint that allows at least one of the at least three joystick segments to rotate on an axis thereof (or generally around an axis that runs the length of the segment) and a corresponding articulated arm joints allows at least one of the three controlled segments to rotate on an axis thereof (or generally around an axis that runs the length of the segment).

In one embodiment, one or more of the servos comprises at least two variable duration pulse generators.

In another embodiment, a method is provided for making a complex joystick control system. The method steps may comprise providing a complex joystick with at least three joystick segments and at least three joystick joints.

Other steps may comprise providing that the three joystick segments may comprise a plurality of joystick segment lengths having a relative ratio of lengths between themselves and are organized in a particular way.

Preferably, the method provides that the three joystick joints permit movement of an end of the complex joystick in each of x, y, and z directions with respect to a first fixed position.

The method may comprise providing at least three electronic joystick angle sensors positioned at the at least three joints which produce control signals based on respective relative angular joystick positions of the three joystick segments with respect to each other and the first fixed position.

Additional steps may comprise providing an articulated arm comprising at least three controlled segments and at least three articulated arm joints.

In one embodiment, the method provides that the controlled segments comprise a plurality of controlled segment lengths having the relative ratio of lengths (and order of attachment) between themselves.

Further, the may comprise providing at least three articulated arm electronic angle sensors positioned at the three joints (or other suitable position) which produce control signals based on respective relative angular articulated arm positions of the controlled articulated arm segments with respect to each other and the second fixed position.

The method may provide at least three servos which receive signals from respective pairs of the electronic joystick angle sensors and the articulated arm electronic angle sensors. The three servos operate actuators to control movement of the articulated arm so that the respective relative angular articulated arm positions of the at least three controlled segments match those of the relative angular joystick positions of the at least three joystick segments.

In one embodiment, the articulated arm joints permit movement of an end of the articulated arm in each of x, y, and z directions with respect to a second fixed position.

For example, the three joystick joints comprise hinged joint between a first pair of the joystick segments wherein the first pair of the joystick segments are constrained to move within a first plane relative to each other (e.g., in the x, y directions) and at least one joint between another pair of the joystick segments that is constrained to move within a second plane (e.g., in the y, z directions or x, y directions) relative to each other wherein the first plane and the second plane are oriented with an angular spacing therebetween.

In one embodiment, the first plane and the second plane are provided orthogonal with respect to each other.

In one embodiment, the method provides the joystick joints have at least one joint that allows at least one of the at least three joystick segments to rotate on an axis thereof and a corresponding articulated arm joint that allows at least one of the at least three controlled articulated arm segments to rotate on an axis thereof.

The method may comprise providing at least one of the servos comprises at least two variable duration pulse generators.

In another embodiment of the present invention, a method for operating a complex joystick system is provided. The joystick and articulated arm or slave unit may comprise more than three segments, more than five segments, more than ten segments, more than twenty segments or more than fifty segments. The joints may comprise both hinge type joints and rotatable joints.

The method may comprise steps such as moving an end of the complex joystick to a selected x, y, z position to thereby cause the articulated arm to move to a corresponding x', y', z' position. In this case, any different x, y, z position translates to a different x', y', z' position. It will be understood that other coordinate systems could be substituted such as cylindrical or spherical coordinate systems and there corresponding variables.

The method of claim wherein an operator utilizes two complex joysticks simultaneously to control two or more articulated arms. Each complex joystick might control a separate articulated arm. For that matter, each complex joystick might operate two different arms that perform the same task at different locations.

In one embodiment, each of the complex joystick and the articulated arm comprise more than ten segments.

The method may comprise operating the complex joystick to catch or throw a moving object. The complex joystick may be utilized to play games such as hitting or catching baseballs or shooting basketballs into a hoop.

The method may comprise utilizing a mold to place against the complex joystick to thereby replicate a shape of the mold in the articulated arm.

The method may comprise utilizing a form to which is applied to the complex joystick to create a sculpture of material in accord with the form. For example, the articulated arm may comprise a cutter, perhaps a rotating or vibrating cutter, which when moved by an operator along the form would cut or shape a hard object such as stone or wood. The method may be used to mold a soft object such as clay. This may involve making large sculptures using small models. The sculptures would have a size according to the size of the articulated arm, which may be in the tens of feet or in the hundred foot range, thereby providing a relatively quick way of making large sculptures.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

DETAILED DESCRIPTION OF THE PREFERRED EMBODIMENTS

The present invention allows control of complex motion with one joystick instead of many levers or use of a computer control. A complex joystick or master unit may be stationary or mobile.

Figure 8A:
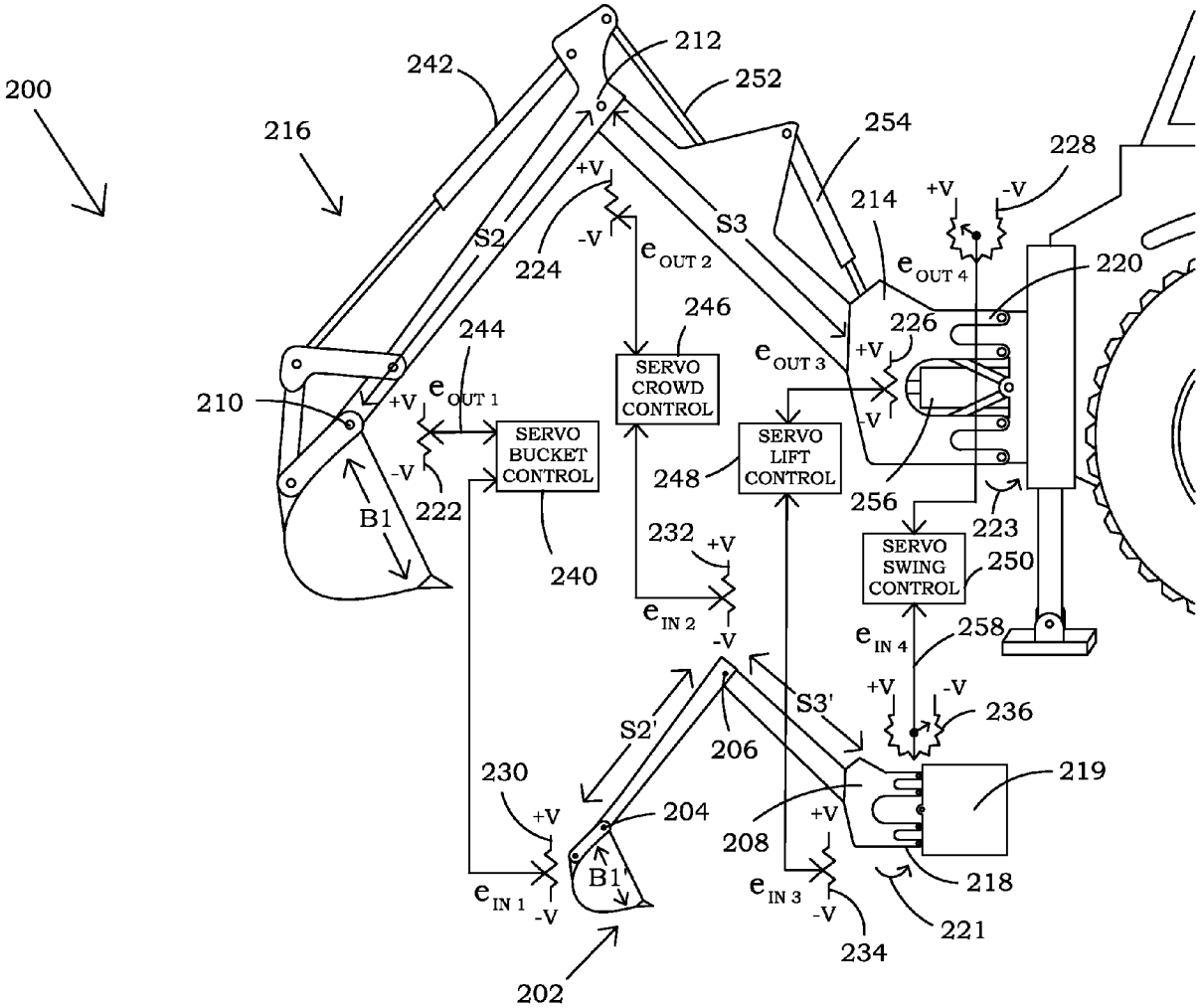
FIG. 8A is a schematic diagram of a back hoe with connections to a complex joystick in accord with one possible embodiment of the present invention.
Figure 9A:
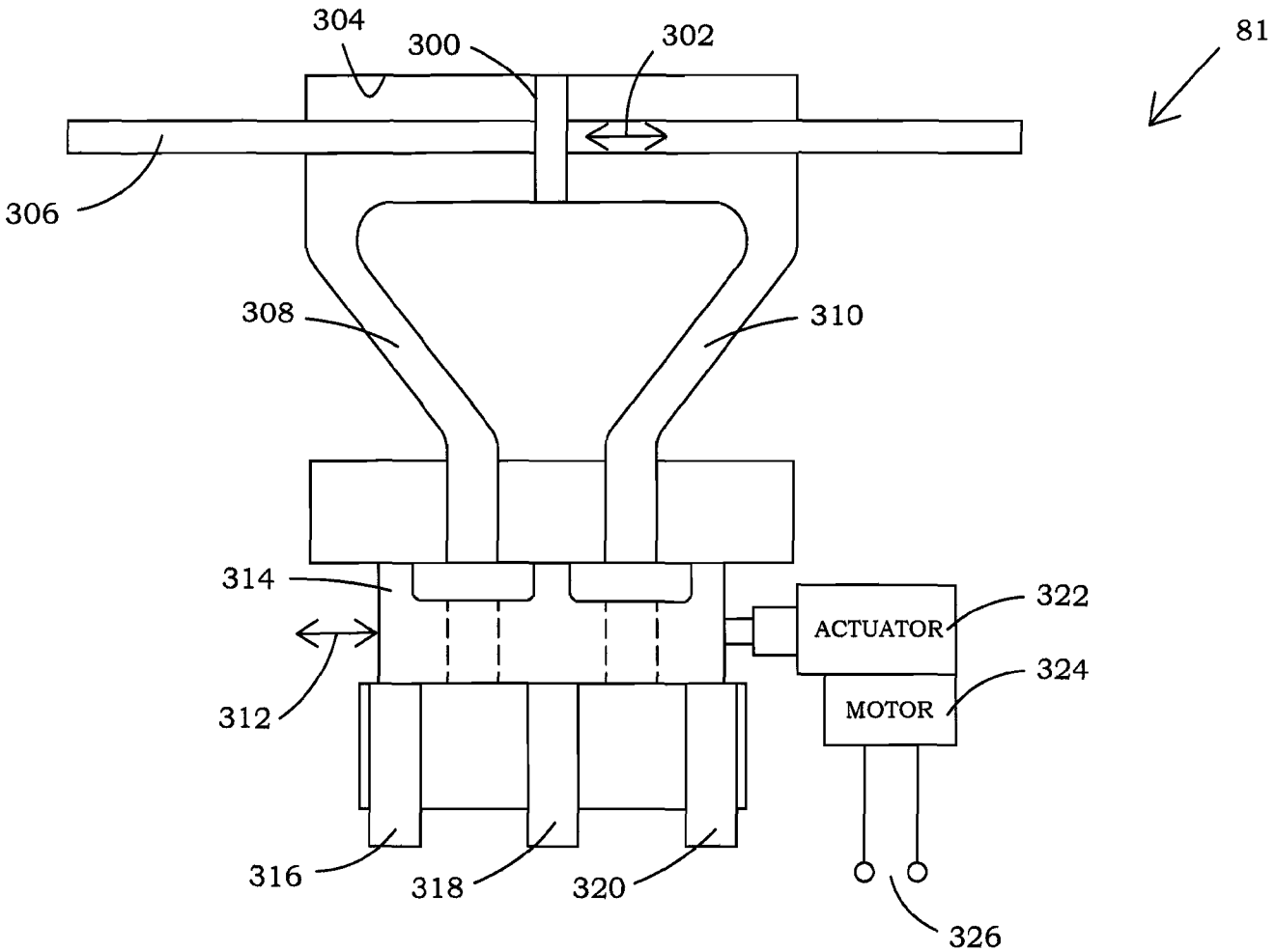
FIG. 9A is a schematic that shows a four-way hydraulic valve and actuator in accord with one possible embodiment of the present invention.
Figure 9B:
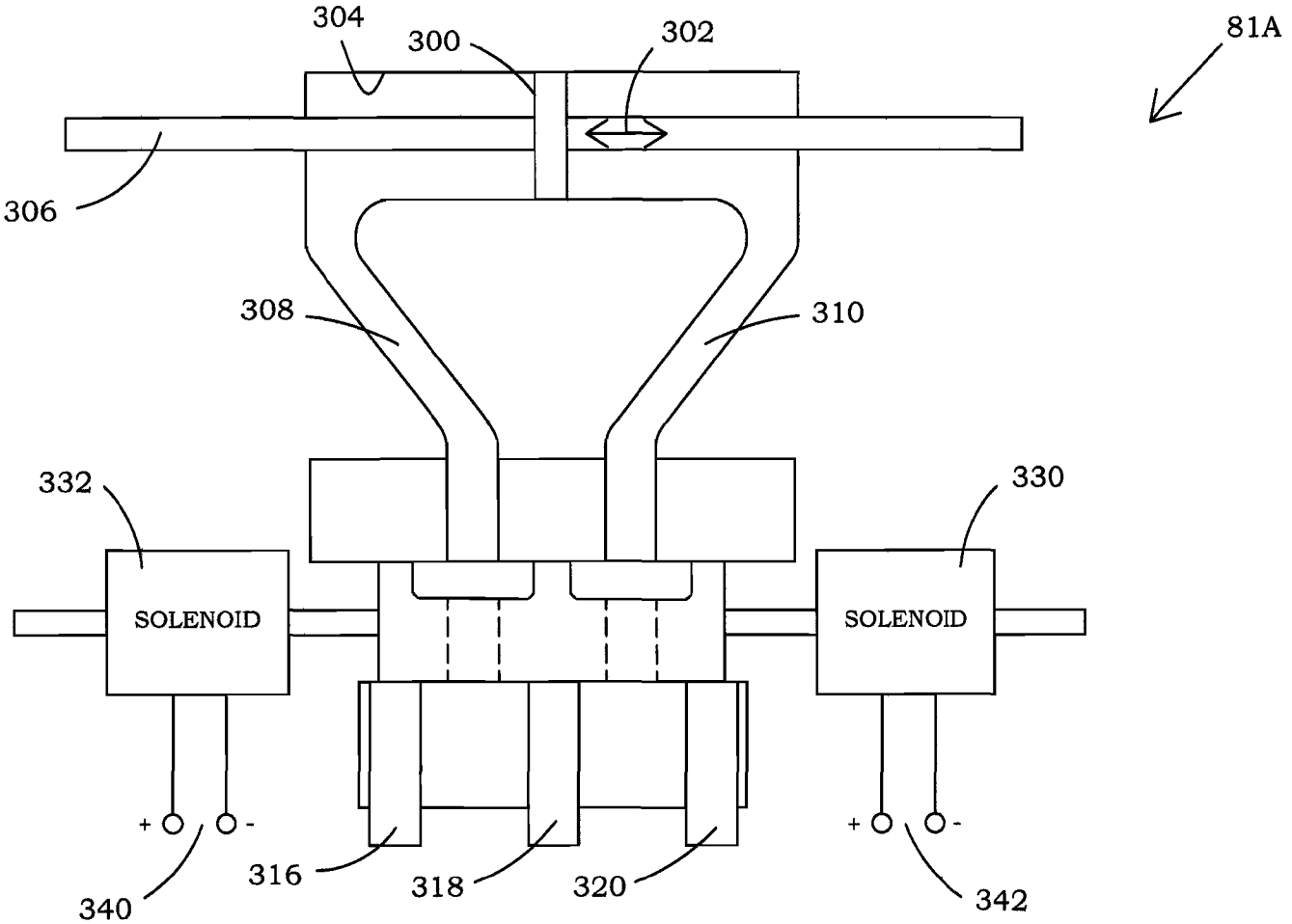
FIG. 9B is a schematic that shows another four-way hydraulic valve/actuator in accord with yet another possible embodiment of the present invention

An example schematic implementation of a complex joystick of for a back hoe is shown in FIG. 8A. In the embodiment of FIG. 8A, four implementations of a control system, such as electro-hydraulic or electro-mechanical control systems, such as that of 10A or 10B (shown in FIG. 1 and FIG. 4, respectively), could be utilized. Examples of four way hydraulic valves/actuators are shown in FIG. 9A and FIG. 9B. Therefore, while only a single electro-hydraulic or electro-mechanical control system will be described in connection with a single joint of the complex joystick, the number of such systems can be large depending on the number joints of pivotal and/or rotatable couplings of the complex joystick utilized, as described hereinafter.

The complex joystick of the present invention may operate various electro-hydraulic, electro-mechanical, electrical control systems. However, a presently preferred electro-hydraulic or electro-mechanical servo control system is disclosed herein that may be utilized to control electric motors and/or hydraulic elements as shown in FIGS. 1-9B. The complex joystick of the present invention may be utilized to operate multiple jointed snaking devices, underground operating devices, animal or bird motions, ice skating motions, and many other types of motions. The complex joystick has civilian and military applications. Conceptually, the complex joystick is based on the theorem that two polygons with similar sides have the same corresponding angles and/or the converse that similar angles have corresponding similar sides. Due to their simple operation, multiple complex joysticks may be operated by one operator.

Figure 1:
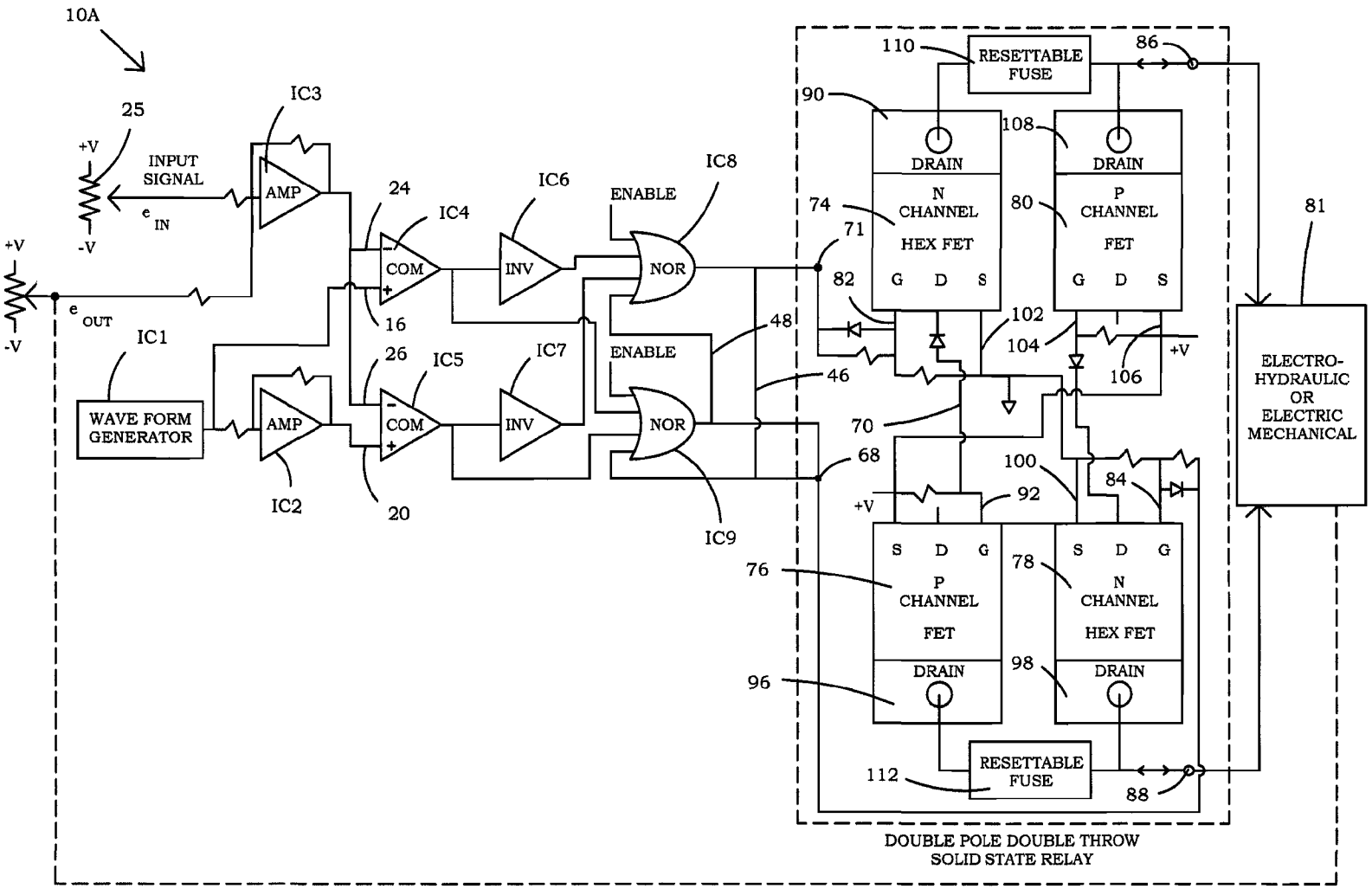
FIG. 1 is a schematic diagram of a possible motor control operable with a complex joystick for controlling motor speed and direction with two variable width pulse generators in accord with one possible embodiment of the present invention.
Figure 4:
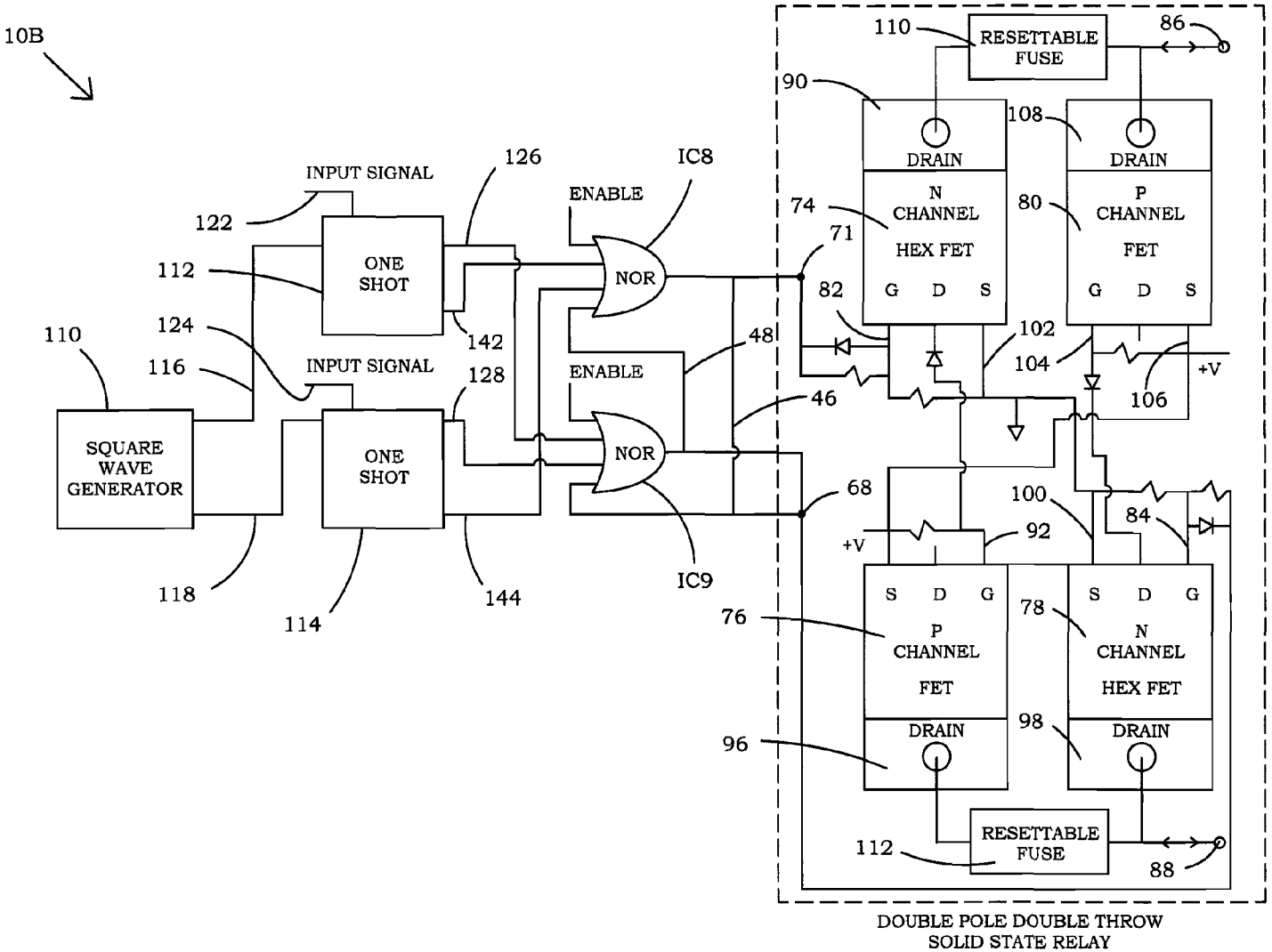
FIG. 4 is a schematic diagram of a motor control operable with a complex joystick for controlling motor speed and direction with at least two variable width pulse generators in accord with another possible embodiment of the present invention.

Accordingly, referring to FIG. 1 and FIG. 4, the presently preferred electro-hydraulic or electro-mechanical servo control system possible embodiment of the present invention may utilize control signals from the complex joystick of FIG. 8A, which in this example of servo systems, alters two streams of pulse width modulated pulses. The streams of pulses are staggered in that they begin at different times. Due to the logic circuit which combines the two streams of pulses, as the pulse widths change from small to large, the direction of movement and speed of movement of, for example, hydraulic and/or electric actuators is produced. With an electric actuator for example, an electric motor can be controlled to rotate at a high speed in one direction, slows down, stop, and then increases speed in the opposite direction. The same control may be effected over a hydraulic actuator. If desired, a hydraulic actuator and/or electrical actuator may also be controlled in an on-off fashion with a set speed using the complex joystick of the present invention. As well a range of speeds may be set. Different types of pulse generators may be utilized in accord with the present invention. Different types of triggers for the pulse generators may be utilized. The system provides low power loss, low cost, low weight, and increased efficiency of the electro-hydraulic or electro-mechanical speed control system.

Referring now to the drawings and more particularly to FIG. 1 and FIG. 4, there are shown circuit diagrams for electro-hydraulic or electro-mechanical control 10A and 10B which utilize two different types of variable width pulse generators, but which may use similar types of logic controls and drivers for the electro-hydraulic or electro-mechanical. A closed loop servo circuit is shown in FIG. 1 and an open loop circuit is shown in FIG. 4. However, the closed loop circuit, which would be utilized with the complex joystick, is the same with the addition of a feedback control element. Changing from an open loop system to a closed loop servo system is also discussed in my previous patent, U.S. Pat. No. 7,421,193, which is incorporated by reference (see for example, the discussion of the joystick control in connection with FIG. 5. of my previous patent).

In system 200 of FIG. 8, feedback elements in the controlled articulated arm segments comprise potentiometer resistors 222, 224, 226, and 228 with wiper arms wherein the resistance and/or voltage at the wiper arms varies based on angular positions of articulated arm segments.

As well, a suitably programmed processor or joystick controlled processor may be utilized as a closed loop control element by sampling the output and producing an appropriate input to control servo electronics circuit 10A and 10B. Thus, the present discussion will center on the open loop circuit with some discussion of equations relevant to the closed loop design but with the understanding that electro-hydraulic or electro-mechanical control 10A and 10B may be utilized in a closed loop design although the system could as well use open loop designs.

In FIG. 1, electro-hydraulic or electro-mechanical servo control electronics 10A utilizes waveform generator IC 1 to produce repetitive waveforms. In one example of electro-hydraulic or electro-mechanical control 10A, triangular waveform 12 is generated, shown in FIG. 2. In another embodiment example of electro-hydraulic or electro-mechanical control 10A, a sinusoidal waveform 14 is generated, such as shown in FIG. 3. Thus, electro-hydraulic or electro-mechanical control 10A is not limited to use of a particular type of waveform. However, in one possible embodiment the waveform is preferably symmetrical and repetitive. The waveform generator may or may not be synchronized with a clock signal, such as the clock signal shown in FIGS. 2 and 3. The waveform generator may comprise an internal clock signal.

Figure 2:
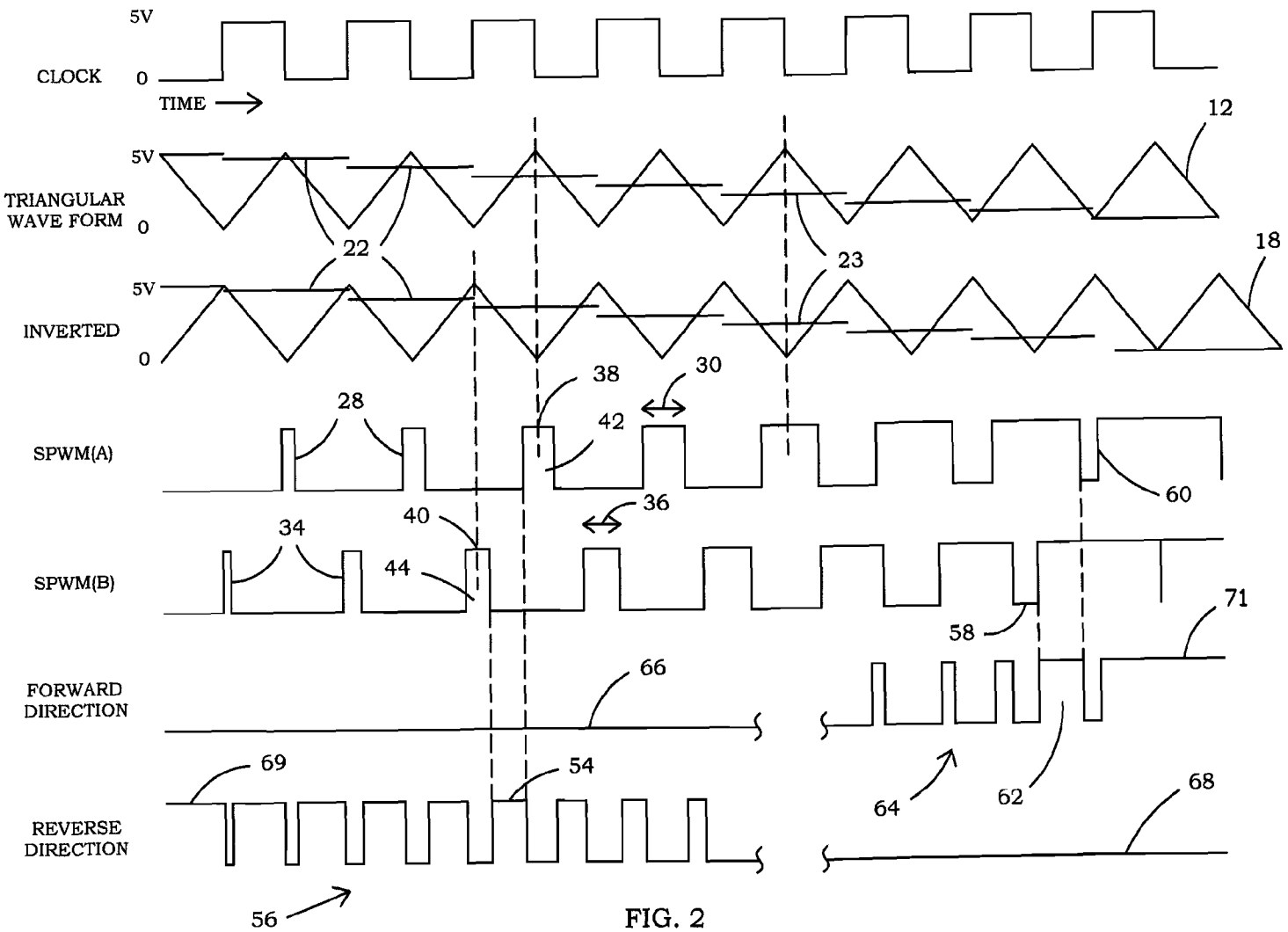
FIG. 2 is a signal diagram of for the motor control of FIG. 1 when used with a triangular waveform generator in accord with one possible embodiment of the present invention.
Figure 3:
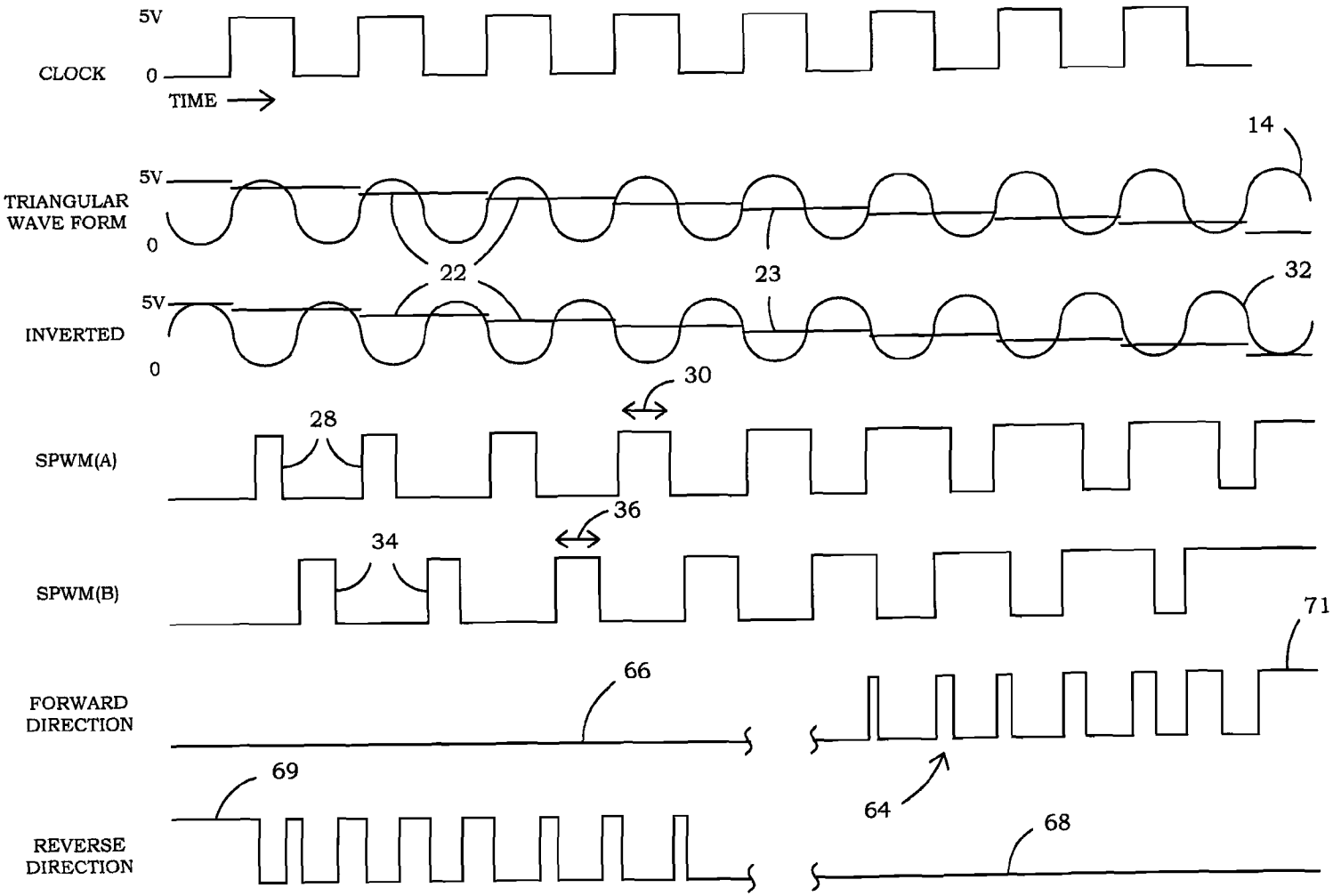
FIG. 3 is a signal diagram of for the motor control of FIG. 1 when used with a sinusoidal waveform generator in accord with one possible embodiment of the present invention.

The output of IC 1, see triangular waveform 12 in FIG. 2 or sinusoidal waveform 14 in FIG. 3, is applied to input 16 of comparator IC4 and inverter IC2. The output of inverter IC2 (see inverted triangular waveform 18 in FIG. 2 or inverted sinusoidal waveform 32 in FIG. 3) is applied to input 20 of comparator IC 5.

Control signal 22, shown in FIG. 2, which is a combination of the input signal of FIG. 1 from an angle sensor of the complex joystick (e.g. 230, 232, 234, or 236) and a corresponding angle sensor (e out) from the controlled articulated arm such as articulated arm 216 in FIG. 8A, (e.g. 222, 224, 226, and 228) can be utilized to control the electro-hydraulic or electro-mechanical actuator speed and direction. In this embodiment, control signal 22 is a variable voltage level as shown in FIG. 2 and FIG. 3.

While in this case, the control signal or input signal, which may be referred to as a combination of $e_{in}$ and $e_{out}$ is produced by voltage dividers where potentiometer 25 could be any one of the wiper of angle sensors 230, 232, 234, or 236 in FIG. 8 or any other sensor, which in this case is connected to plus and minus voltage sources at opposite ends. The signal of $e_{out}$ is produced based on the angular position of the articulated arm segment to be controlled. Other means for control might include a suitably programmed processor which produces programmed voltage levels in response to programming, user input, feedback, and the like.

In this example, when control signal 22 varies continuously with respect to triangular waveform 12 from +5 volts to the middle of the voltage range as indicated at 23, then in the open loop the AC or DC motor slows continuously from a high speed to zero RPM. In the closed loop, as explained in my previous patent, the actuator moves until a null is produced. As control signal 22 varies with respect to triangular waveform 12 towards the zero volt level from middle level 23, the motor is initially at zero RPM and is then driven in a first direction, which may be a forward direction, at increasingly higher speed. As control signal 22 varies with respect to triangular waveform 12 from the middle of the voltage range 23 towards +5 volts, the motor and/or actuator is driven in the opposite direction, such as a reverse direction, at increasing higher speed.

In the open loop, at the maximum voltage levels with respect to the reference waveform, in this example at +5 and 0 volts, the motor and/or actuator is driven continuously on in the reverse direction or the forward direction, respectively. At the middle of the voltage range, the motor speed is zero RPM. In a closed loop system, this occurs when $e_{in}$ and $e_{out}$ are equal or nulled. It will be appreciated that the relative voltage levels may change and that use of both plus and minus voltage supplies are not necessarily required.

If desired, input control signal 22 may be applied to gain and stability IC3 which may adjust the open or closed loop servo gain relative to the output of IC1 and perhaps also provide stability to the servo loop. Other types of circuitry could also be utilized for controlling the relative gain and stability in IC1 and the input signal 22 of the servo loop.

The output of IC3, which is the combination of $e_{in}$, and $e_{out}$, referred to as control signal 22 is applied to comparators IC4 and IC5, at respective inputs 24 and 26. A reference signal, such as a waveform, is applied to inputs 16 and 20 of IC4 and IC5. In this example, control signal 22 is compared with triangular waveform 12 or sinusoidal waveform 14 in comparator IC4 and is also compared to inverted triangular waveform 18 or inverted sinusoidal waveform 32 in comparator IC5.

The output of IC4 or IC5, which is labeled SPWM(A) or SPWM(B) in FIG. 2 and FIG. 3, respectively, in FIG. 2 and FIG. 3, is a positive output when input control signal 22 is greater than the reference. Likewise, the output of IC4 and IC5 is zero when the input control signal is less than the reference signal.

Accordingly, when triangular waveform 12 or sinusoidal waveform 14 is greater than control signal 22, then the output of IC4, which is labeled SPWM (A) in FIG. 2 and FIG. 3, is positive. Due to the repeating nature of the waveform, first series of pulses 28 is produced, as shown in FIGS. 2 and 3. As control signal 22 decreases, the duration or pulse width 30 of pulses 28 increases. This is because the time which triangular waveform 12 or sinusoidal waveform 14 is greater than control signal 22 increases as control signal 22 decreases.

Likewise, when inverted triangular waveform 18 or inverted sinusoidal waveform 32 is greater than control signal 22, then the output of IC5, which is labeled SPWM (B) in FIG. 2 and FIG. 3, is positive. Due to the repeating nature of inverted triangular waveform 18 or inverted sinusoidal waveform 32, second series of pulses 34 is produced. It will be appreciated that as control signal 22 decreases, that the duration or pulse width 36 of second series of pulses 34 increases. This is because the time which inverted triangular waveform 18 or inverted sinusoidal waveform 32 is greater than control signal 22 increases as control signal 22 decreases.

It will also be appreciated that first series of pulses 28 is staggered with respect to second series of pulses 34. In this example, as shown in FIG. 2, pulse center 38 of first series of pulses 28 is 180 degrees out of phase with pulse center 40 of second series of pulses 34 as compared to the triangular waveform. The same is also true when using the sinusoidal waveform of FIG. 3.

The differences in waveform shape affects control features to some degree. For example, a finer high speed adjustment may be available with a triangular waveform. Other waveforms besides sinusoidal or triangular waveforms might also be generated for use with the present invention if desired for particular applications.

The logic circuitry which is used to combine first series of pulses 28 and second series of pulses 34 includes inverters IC6 and IC7 and NOR gates IC8 and IC9. Pulse outputs from IC8, which may be called forward control pulses, drive the electro-hydraulic or electro-mechanical actuator in a first direction, which is called a forward direction for discussion herein. Pulse outputs from IC9, which may be called reverse control signals, drive the electro-hydraulic or electro-mechanical actuator in a second direction opposite to the first direction, which is called a reverse direction for discussion herein. While relatively simple logic circuits may be utilized for implementing the invention, it will be understood that the invention may also be implemented other logic components, utilizing a processor which is programmed to operate in accord with the discussion herein, and the like.

The outputs of both IC4 and IC5 are applied to NOR gate IC9. The inverted outputs of both IC4 and IC5 are applied IC8.

In more detail, first series of pulses 28 (See FIGS. 2 and 3) produced by comparator IC4 is applied to the input of inverter IC6 and to the input of NOR gate IC8. Second series of pulses 36 (See FIGS. 2 and 3) produced by comparator IC5 is applied to the input of inverter IC7 and to the input of NOR gate IC8. The output of inverter IC6 is applied to the input of NOR gate IC8. The output of inverter IC7 is applied to NOR gate IC9.

Looking first at NOR gate IC9, and specifically at pulses 42 and 44, it will be appreciated that NOR gate IC9 will produce a logic zero output at the times of pulse 42 and 44. More generally, NOR gate IC9 will produce a logic one output only when all inputs are logic zero. Thus, so long as the combined pulse widths of first series of pulses 28 and second series of pulses 34 is less than the period of the waveform, then there will be times during the period of the waveform when IC9 will be one. For example, between pulse 42 and 44, then reverse control pulse 54 is created. It will be appreciated that pulses such as reverse control pulse 54 are created whenever this gap occurs. Thus, reverse control pulses 56 will be produced by NOR gate IC9 to drive a motor and/or electro-hydraulic or electro-mechanical actuator in the reverse direction. A more detailed analysis is directly below in the next paragraph.

Assuming that ENABLE control for IC9 is at logic zero, then the output of IC9 will be one except when at least one of the two series of pulses are one. For example, consider pulses 42 and 44. During pulses 42 and 44, IC9 will produce a logic zero. However, between pulses 42 and 44, when SPWM (A) and SPWM (B) are both zero, IC9 will produce a logic one output, which is reverse control pulse 56. As the pulse widths increase in size, the time for which NOR gate IC8 produces a logic one, decreases. Thus, because IC8 drives the electro-hydraulic or electro-mechanical actuator in the reverse direction, the speed of rotation in the reverse rotation decreases as the pulse widths 30 and 36 increase. This continues until the combined pulse widths are greater than the cycle time of the waveform.

As the pulse widths continue to increase, rotation in the reverse direction completely ceases as indicated at reverse zero output 68. In this example, this occurs when the control signal is zero as indicated at 23. After the pulse widths reach this width, at least one input to NOR gate IC9 will always be logic one, so that the output is zero. On the other hand, the speed of reverse rotation increases as the pulse widths of first series of pulses 28 and second series of pulses 34 decreases. At some point in the reverse direction, the output of NOR gate IC9 remains a logic one as indicated at 69. Thus, one possible embodiment of the present invention provides a means to produce a 100% duty cycle for maximum power applied to a motor and/or electro-hydraulic or electro-mechanical actuator.

After the above analysis, it will be appreciated so long as the total pulse width of the first and second series is less than the period of the waveform direction of the motor is reverse. Therefore, the inverse of these pulse widths will be greater than the period of the waveform. Thus, during this time NOR gate IC9 will always have at least one input which is one and will therefore always have an output of zero, as indicated at forward zero output 66.

However, when the combined pulse widths of the first and second series of pulses is greater than the period of the waveform, then the combined pulse widths of the inverses of the first and second series of pulses will be less than the period of the waveform. Because the inverses of the first and second series of pulses is applied to NOR gate IC8, as the pulse widths 30 and 36 continue to increase, a motor and/or the electro-hydraulic or electro-mechanical actuator will eventually rotate or move in the forward direction and increase with increasing pulse width. For example between the inverse of pulses 58 and 60, then forward pulses, such as forward control pulse 62, are produced by NOR gate IC9. Forward control pulses 64 are thereby created to cause rotation of the motor in the forward direction and/or corresponding movement of the electro-hydraulic or electro-mechanical actuator. If the width 38 and 40 increases, then eventually the output of NOR gate IC8 remains a logic one as indicated at 71. Thus, one possible embodiment of the present invention provides a 100% duty cycle in both the forward and reverse directions whereby the output remains at one over the entire waveform cycle.

In case the circuit or hardware does not work perfectly, due to power fluctuations or the like, anti-coincidence lines 46 and 48 may be utilized to ensure that when one of the NOR gates is on and producing a logic one, that this logic one is also applied to the other NOR gate to ensure it is turned off.

When control signal 25 is in the center position at zero volts, as indicated at 23 in FIG. 2 and FIG. 3, then the combined pulse widths of the first and second series of pulses is equal to the period of the waveform and so at least one input to both NOR gate IC8 and NOR gate IC9 are always equal to one. Thus, no control pulses are produced, and the motor and/or electro-hydraulic or electro-mechanical actuator is stopped.

To avoid the possibility of minor voltage fluctuations creating any short transient pulses produced at the stop position, various methods may be utilized. If computer controls are utilized, then at the null point, the computer can apply a logic one signal to the ENABLE inputs of the NOR gates to turn them off. It will also be noted that a switch to the ENABLE inputs of the NOR gates may be utilized to place the system in a sleep mode by setting the ENABLE inputs to a logic 1, which turns off the electro-hydraulic or electro-mechanical actuator while leaving the control circuits active, if desired. The response time until the system is operational is then somewhat faster as compared to turning the power off and on.

Various devices may be utilized to drive the electro-hydraulic or electro-mechanical actuator once the forward control pulses 65 and reverse control pulses 56 are produced. My previous patent discloses solid state and mechanical relays, which can be utilized to control a motor and/or electro-hydraulic or electro-mechanical actuators. While commercial relays are available, one possible embodiment of the present invention utilizes a unique N-channel and P-channel FET drive for permanent magnet DC motor 150 where the change in direction is produced by change in current direction. The motor control of one possible embodiment of the present invention is believed to be more efficient with less potential power loss. Other types of N-channel and P-channel devices, silicon rectifiers, triacs for AC motors, and the like might also be utilized.

In this embodiment, N-channel FET 74 and P-channel FET 76 are utilized to drive the motor and/or electro-hydraulic or electro-mechanical actuator in the one direction. At this time, N-channel FET 78 and P-channel FET 80 are off.

N-channel FET 78 and P-channel FET 80 are utilized to drive the motor and/or electro-hydraulic or electro-mechanical actuator in the reverse direction. At this time, N-channel FET 74 and P-channel FET 76 are off.

The motor terminals 86 and 88 are connected to the motor. In the forward direction, positive pulses are applied to the motor. In the reverse direction, the polarities of the pulses are reversed, so that effectively negative pulses are applied to the motor and/or used to control the electro-hydraulic or electro-mechanical actuator.

Forward control pulses 65 are applied to gate 82 of N-channel FET 74. Reverse control pulses 56 are applied to reverse transistor 72 and gate 84 of N-channel FET 78. The Drain may be connected to power by line 70.

With no pulses produced by either NOR gate IC8 or NOR gate IC9, then all FETS and transistors turned off. In this case, the motor and/or electro-hydraulic or electro-mechanical actuator is disconnected from all power sources and ground.

When a forward pulse is produced from NOR gate IC8, the pulse at gate 82 turns on N-Channel FET 74, which connects motor terminal 86 to ground at drain 90 of N-channel FET 74 because source 102 is connected to ground. At the same time, the forward pulse also turns on forward transistor 70, which turns on P-channel FET 76 by connecting gate 92 of P-channel FET 76 to ground. The positive voltage connected to source 94 of P-channel FET 76 is then supplied to drain 96 of P-channel FET 76. This supplies positive voltage to terminal 88 with terminal 86 at ground. Therefore, the motor and/or electro-hydraulic or electro-mechanical actuator moves/rotates in the positive direction.

When a reverse pulse is produced from NOR gate IC9, the pulse at gate 84 turns on N-channel FET 78, which connects terminal 88 to ground at drain 98 of N-channel FET 78 because source 100 is connected to ground. At the same time, the reverse pulse also turns on P-channel FET80 by connecting gate 104 of P-channel FET 80 to ground. The positive voltage connected to source 106 of P-channel FET 80 is then supplied to drain 108 of P-channel FET 80. This supplies positive voltage to terminal 86 with terminal 88 at ground. Therefore, the motor and/or electro-hydraulic or electro-mechanical actuator moves/rotates in the negative direction.

Although N-channel FET 74 and P-channel FET 80 are never on at the same time, resettable fuse 110 is utilized to protect the FETs from damage in case of an accident. Likewise, fuse resettable fuse 112 protects N-channel FET 78 and P-channel FET 76.

Figure 10A:
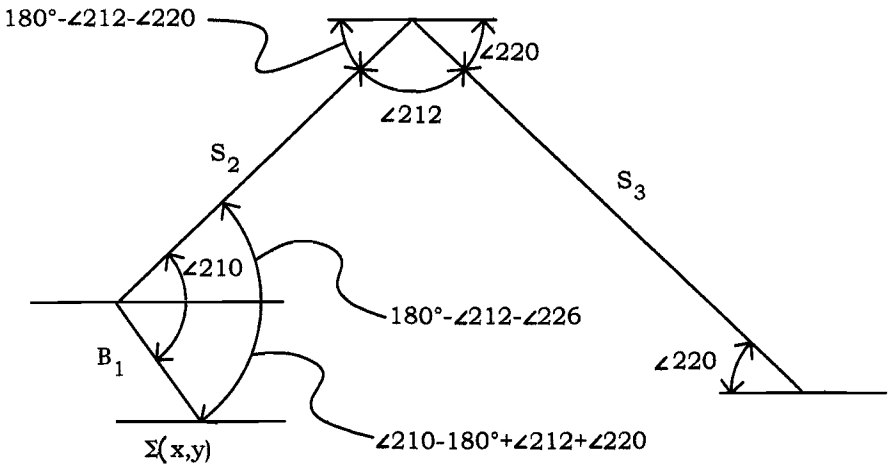
FIG. 10A is a geometrical diagram showing computations involved in determining a position of a bucket at an x, y position for a back hoe and/or computations to determine angles of segments of an articulated arm given the x, y position in accord with one possible embodiment of the present invention.
Figure 10B:
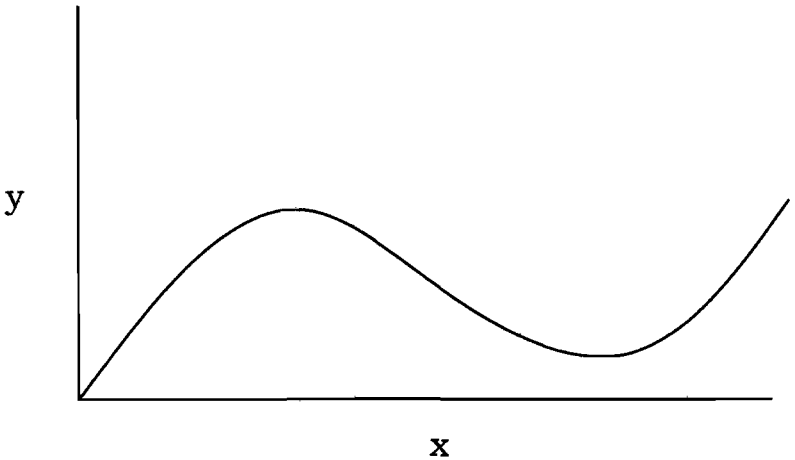
FIG. 10B is a complex curve which could be emulated by use of a complex joystick in accord with one possible embodiment of the present invention.

Electro hydraulic or electrical mechanical actuators may be operated by the servo system of FIG. 10A or 10B or another servo system. For example, solenoids or valves may be controlled which operate hydraulic 242, 252, 254, and 256 of FIG. 8A. As the articulated arm 216 segments change orientations, the wipers of potentiometers 222, 224, 226, and 228 produce signal $e_{out}$ which can then be added/subtracted from $e_{in}$ to control the servo output as discussed above.

As stated hereinbefore, the control circuit of the present invention can be implemented in different ways. Referring now to motor control 10B, shown in FIG. 4, yet another embodiment of the invention is shown. The logic circuitry and motor drive circuitry is identical to that previously discussed in FIG. 1 and is therefore not repeated.

In this embodiment, square wave generator 110 may be utilized to drive one shots 112 and 114 at alternating times of the square wave. In this embodiment, square wave generator 110 produces a square wave at output 116 and an inverse square wave at inverse output 118. Other waveforms such as pulses, sine wave, or the like, might also be utilized to trigger the one-shots.

Figure 5:
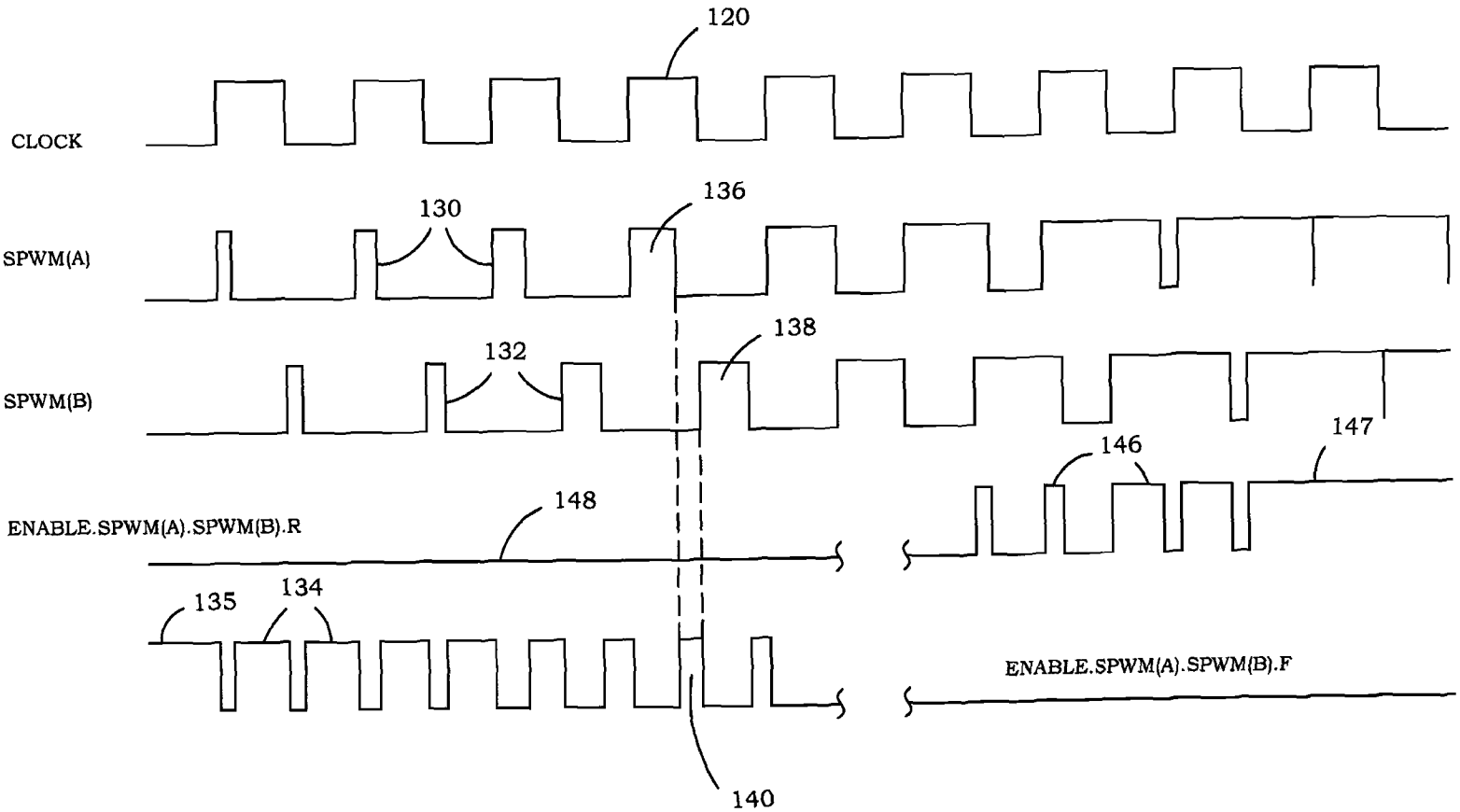
FIG. 5 is a signal diagram of for the motor control of FIG. 4 when used with two variable width pulse generators in accord with one possible embodiment of the present invention.

Square wave 120, shown in FIG. 5 is representative of output 116 and it will be understood an inverse to this square wave, which is not shown in FIG. 5, is also produced. In this embodiment, each one shot is triggered by the rising edge of the waveform once each period of the waveform. Thus, each one-shot is triggered 180 degrees apart with respect to square wave 120.

A variable voltage or the like may be utilized to control the pulse widths of the one-shot pulses and may be connected to both one-shot inputs 122 and 124. For example, a voltage divider or potentiometer, such as voltage divider or potentiometer 25 may be utilized to control the pulse widths produced by the one-shots. The adder/subtractor circuit of IC3 in FIG. 1 may be used as the input signal for servo control. However, it will be understood that variations of controls for one-shots are well known and that different devices may be used, some of which are discussed in my previous patent referred to hereinbefore.

By varying the one-shot inputs 122 and 124, the pulse width of the one-shot outputs vary. Thus, at one-shot output 126, variable width pulses 130 as indicated at SPWM (A) are produced and applied to NOR gate IC9. Likewise, at one-shot output 128, variable pulses 132 as indicated at SPWM (B) are produced and applied to NOR gate IC9.

As previously discussed, when all inputs to NOR gate IC9 are zero, then reverse control pulses 134 are produced. For example, between pulse 136 and 138, a reverse control pulse 140 is generated. As discussed before, varying the width of these pulses will vary the reverse rotational speed and/or electro-hydraulic or electro-mechanical actuator movement/rotation. The narrower the width of pulses 130 and 132, then faster the reverse rotational speed and/or electro-hydraulic or electro-mechanical actuator movement. In one possible open loop embodiment of the present invention, the reverse control may remain on constantly as indicated at 135. Refer to the previous discussion for more details.

In this embodiment, the inverse of one-shot outputs 126 and 128 are produced at one-shot inverse outputs 142 and 144. The operation of IC8 to produce forward control pulses 146 was discussed hereinbefore. When the inputs to IC8 are zero, forward control pulses are produced.

As before, when the output of IC8 is zero as indicated at 148, then reverse control pulses 134 may then be produced by IC9. When the output of IC9 is zero as indicated at 150, then IC8 may produce forward control pulses 146. Once the combined pulse width of pulse 130 and 132 is greater than the cycle of square wave 120, only forward control pulses are produce. After this, the wider the width of pulses 130 and 132, then faster the forward rotational speed and/or electro-hydraulic or electro-mechanical actuator movement/rotation. In one possible embodiment of the present invention, the forward control may remain on constantly as indicated at 147.

The operation of IC8 and IC9 and the FETs is the same and reference may be made to the previous discussion in connection with FIG. 2 and FIG. 3 for more details.

Figure 6:
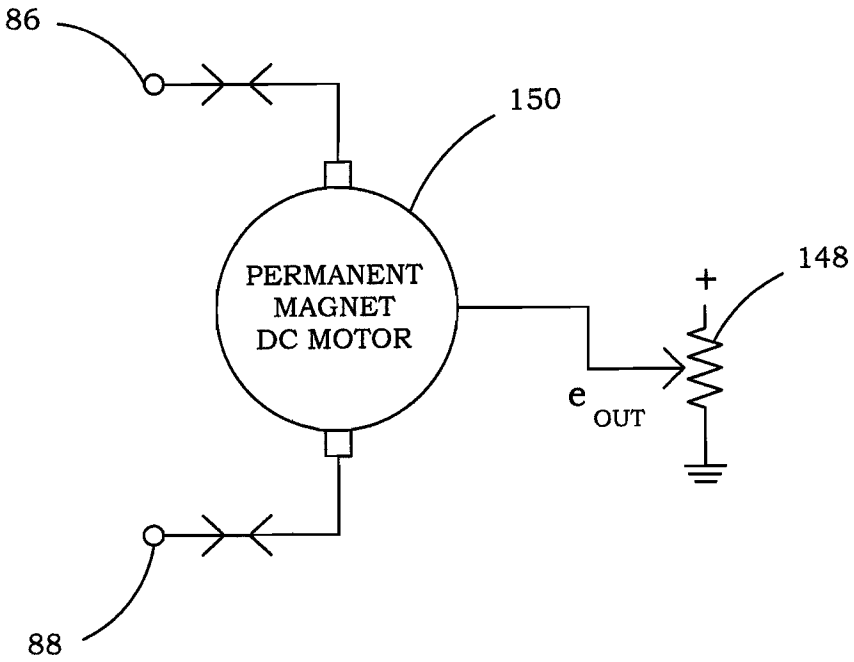
FIG. 6 is a schematic diagram of a DC electric motor with feedback element in accord with one possible embodiment of the present invention.

FIG. 6 shows motor 150 which may have a shaft operably connected to feedback control element 148. Additional details for changing an open loop control system to a closed loop control system are shown in my previous patent.

Figure 7:
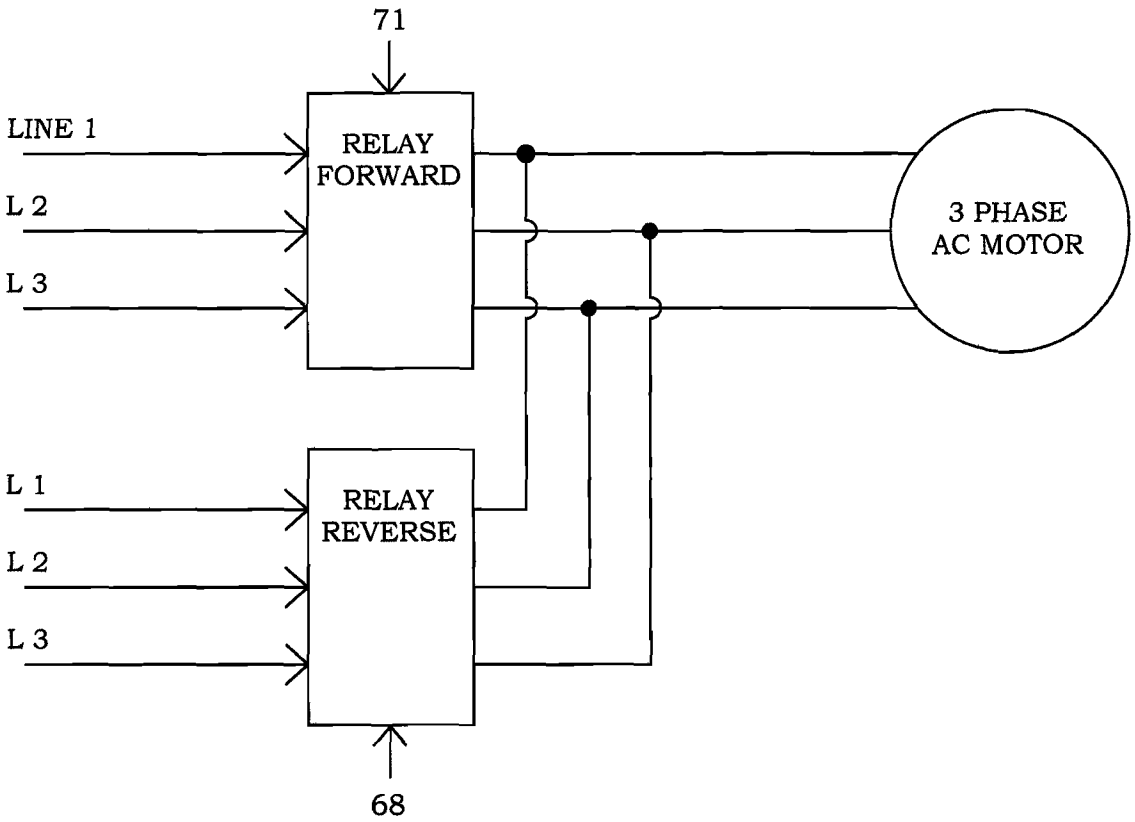
FIG. 7 is a schematic diagram of an AC electric motor drive in accord with one possible embodiment of the present invention.

FIG. 7 shows a three phase motor being operated by pulses produced at 71 and 68 with the relay forward and relay reverse replacing the double pole double throw solid state relay shown in FIG. 1 and FIG. 4. In this example, the relays apply the three phase AC power to the 3 phase AC motor whenever a motor control signal turns on the relays. The motor windings are effective rewired, with any two of the phases reversed, for forward and reverse directions depending on which relay is activated. In this example, the connection of the L2 and L3 phases to the AC motor are changed depending on whether the forward relay or the reverse relay is activated. As discussed previously, the relays may represent solid state or mechanical relays.

A single phase AC power signal could be handled in a similar manner. and motor starter circuits may also be utilized. The pulse generation circuitry for the AC motor control is the same as that for the DC motor control.

A general motor control system in accord with One possible embodiment of the present invention may be described by the following equations:

For open loop operation:

$$e_{out}=G(s)e_{in}$$

where $e_{in}$ is the input signal applied to the variable pulse duration pulse generators discussed hereinbefore:

G(s) is the transfer function of the control system.

$$G(S) = F(s)\cdot\left[M\left(\frac{ds^2}{dt}\right)+F\left(\frac{ds}{dt}\right)+K(s)\right],$$

where

F(s) represents the stability of the system, $M\left(\frac{ds^2}{dt}\right)$ represents the system inertia, $F\left(\frac{ds}{dt}\right)$ represents the system friction, and K(s) represents the system potential.

For closed loop operation:

$$e_{in}-e_{out}=\text{error}$$

where $e_{out}$ is measured at feedback control element 148.

Then, it can be shown that:

$$e_{out}=[G(s)/(1+G(s))]e_{in}$$

The compensation or stability is utilized to avoid 1+G(s)=0.

The system of one possible embodiment of the present invention is based on the use of pulse durations for driving the motor backward or forward and the absence of pulse duration to cause the motor to be stationary or nulled. The invention may be applied for servo control of both small and large motors with the same basic design and the use of relays, power transistors, and FETs for driving the motors and/or hydraulic actuators or the like.

FIG. 8A is a schematic view of electrical connections for a complex joystick control system 200 in accord with one possible embodiment of the present invention. In this embodiment, complex joystick 202 comprises four joints, three of which are hinge connections and one of which is a rotary connection. Essentially, in this case and in other embodiments, the joystick may be a miniature representation of the articulated arm 216 or other articulated arm to be controlled. The miniature bucket might be replaced by an arm as the actual bucket would not be necessary. However, for simplicity, it is shown here.

The three hinge connections 204, 206, and 208 of complex joystick 202 correspond to the three hinge connections 210, 212, and 214 of back hoe arm 216. Rotary connection 218 of complex joystick 202, which permits rotation or swinging of the joint, as indicated by arrow 221, connects to base 219 that may contain electronics. Rotary connection 218 corresponds to rotary connection 220 of back hoe arm 216, which swings back hoe articulated arm 216 to and fro, as indicated by arrow 223. Thus, in this embodiment complex joystick 202 is able to effect movement of back hoe articulated arm 216 in any x-y-z direction.

Thus, while joints 210, 212, and 214 may move only in an x-y direction or plane, the x-z movement of rotary connection provides another plane of movement, which allows the end or bucket of back hoe articulated arm 216 to move and be positioned at a desired x, y, z position.

Although not necessarily required, in one embodiment of the invention, the dimensions of complex joystick 202 are analogous to the dimensions of back hoe arm 216. In other words, the proportions of distances B1, S2, and S3 of back hoe arm with respect to each other are the same as the proportions of distances B1', S2' and S3' of complex joystick 202. For example if B1, S2, and S3 are 10 3 feet, 10, feet and 10 feet (a 3:10:10 ratio), B1', S2', and S3' may be 3 inches, 10 inches and 10 inches to provide the same 3:10:10 ratio. Because the dimensions are proportional, the angles between the sides are the same based on geometrical principles where similar triangles or polygons with proportional sides have the same angles. Therefore, the control of a back hoe in this case, is more intuitive where the sides are proportional. Simply by moving joystick arm 202 to the desired position, back hoe articulated arm 216 takes on the same position.

In this embodiment, the angle sensors for each joint of back hoe arm 216 may comprise circular resistors or potentiometers mounted at the joints. However, other types of angle sensors might be used on at least some segments of back hoe arm 216. For example, a pendulum type sensor, laser sensor, bubble sensor, or other type of angle sensor might be utilized for at least some angle measurements between the segments.

In this embodiment, potentiometers 222 224, 226, and 228 may be mounted at the joints 210, 212, 214, and 220. The potentiometers are connected to voltages, in this case +V and −V. Corresponding joystick potentiometers may also comprise circular resistors mounted on complex joystick 202 hinges such as potentiometers 230, 232, 234, and 236 shown schematically. In one embodiment, these resistors are supplied at the opposite ends with the same voltages as are supplied on the back hoe resisters, regardless of what the chosen voltages are. In this way the respective servo will be better able to null the voltages whereby the angles and rotational orientations of the complex joystick 202 will be replicated in back hoe arm 216.

As one example, if the complex joystick bucket B1' is rotated in a desired ways such as scooping of dirt, the orientation of the actual bucket B1 follows the same motion due to operation of servo bucket control 240 which activates hydraulic actuator 242. At any particular point of movement as B1' is rotated, a signal is produced at $e_{in1}$, which is the voltage on the wipe on potentiometer 230. This voltage is applied to servo bucket control 240, which causes movement of hydraulic actuator 242 until the voltage produced on wipe 244 of potentiometer 222 is equal to that of $e_{in1}$. In other words, a null is produced. Servo bucket control 240 can be the same as that shown in a closed loop version of the servo systems of FIG. 1 and/or FIG. 4. As discussed above, changing an open loop system to a closed loop feedback system is well known, an example of which is shown in my previous U.S. Pat. No. 7,421,193 B2 (incorporated by reference) in FIG. 5, as discussed hereinbefore.

A similar nulling operation occurs to cause movement utilizing servo crowd control 246, servo lift control 248, and servo swing control 250. Corresponding hydraulic actuators 252, 254, and 256 are utilized for this purpose.

Accordingly, by simply moving the easily visualized and operable complex joystick 202, the four actuators and valves used to move articulated back hoe arm 216 can be operated in a highly intuitive manner. In many cases, the operation is also less tedious than using the levers. However, if desired, both types of controls could be present so that the operator has a choice.

Figure 8B:
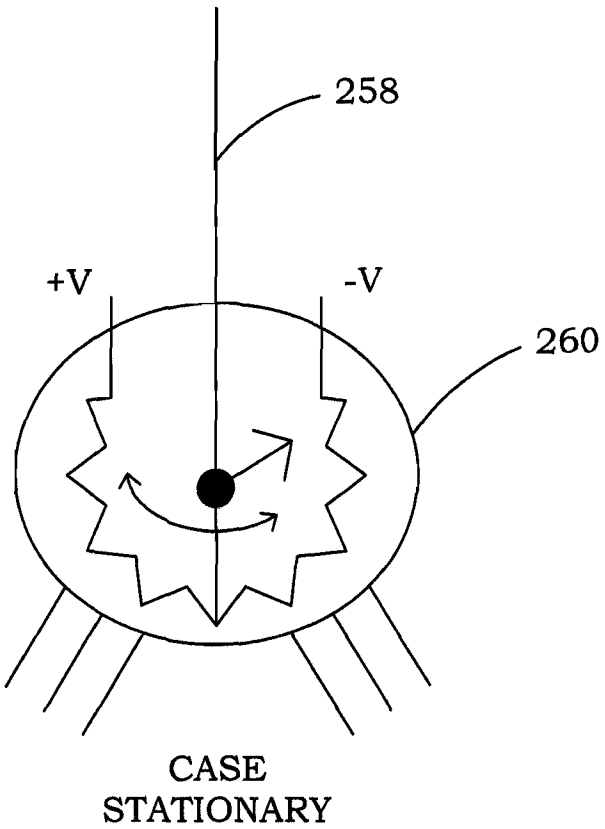
FIG. 8B is a schematic that shows an angular sensor and segment that rotates on an axis thereof drive in accord with one possible embodiment of the present invention.

In this example, swing of back hoe arm is produced by swinging in a similar way the corresponding arm or shaft 258 of complex joystick 202. FIG. 8B shows a schematic version where shaft 258 rotates the wiper of a potentiometer whereby a rotatable shaft movement can be replicated. In cases where the cab rotates with a shovel, then rotation of the cab could be effected by rotation of the complex joystick, thereby eliminating more controls. Thus, FIG. 8A shows an enlarged example of shaft 258 of complex joystick with corresponding circular potentiometer resistor 236. Case 260 of the potentiometer is stationary as compared to shaft 258. Rotary potentiometers could be used at each joint in the present invention, where the case is mounted to one segment and the wiper is moved by angular motion of the adjacent segment.

As one example of the operation of back hoe arm 216, complex joystick 202 preferably comprises arms or links or segments between the joints of length B1', S2', and S3' that are proportional to the length of segments B1, S2, and S3. The proportional lengths are also connected in the same order so that the ratio of the segments is the same, as discussed above. $E_{in1}$ of potentiometer 230 is used to open/close the bucket which is connected to a servo bucket control and/or an optional valve lever control to rotate and/or dump the bucket. Likewise, movement of any joint and corresponding segments of complex joystick 202 produces electrical angle signals for application to the corresponding servo.

When the complex joystick is moved in the x, y, and z direction, the corresponding potentiometers of each joint produce outputs or voltages of the wipers at $E_{in1}$, $E_{in2}$, $E_{in3}$, and $E_{in4}$. The servos produce movement of back hoe arm 216 until all the potentiometers 222, 224, 226, and 228 produce outputs at their wipers leading to the servos which that null the voltage inputs to each servo. When the voltages are nulled, then back hoe arm 216 is in the same relative position, with identical angles between the arms, as those of complex joystick 202, assuming the arm lengths of the back hoe and the complex joystick are proportional.

As noted above, each potentiometer may be comprise a circular resistor attached to one side of the joint of the back hoe and the complex joystick, where the potentiometer wiper is connected to the other adjacent joint via a rotating shaft at the hinge or the like, resulting in an electrical output representative of the angle at the joint. The electrical signal for each joint is preferably connected to inputs for the digital pulse modulation system shown in FIG. 1-7, causing the back hoe servo to change the respective angle that causes a signal produced by the potentiometer at the joint to null the respective servo. An input of x', y', z' (A') results in an outputs of x, y, z (A) in proportion depending on the input complex joystick ratio to the output object.

FIG. 9A and FIG. 9B show conceptual examples of electro-hydraulic actuators 81A and 81B, which may be utilized with control systems 10A and 10B. However, there are many types of actuators, valves, and the like which could be utilized as actuators.

Referring to both FIG. 9A and FIG. 9B, which include many of the same parts, there is shown a movable piston 300, which may be utilized to operate shaft 306. Shaft 306 and piston 300 are moveable back and forth as indicated at 302 in response to operation of control system 10A and 10B, discussed hereinbefore. Piston 300 is positioned in cylinder 304 and moves in response to hydraulic fluid flow in conduits 308 and 310. Relatively high pressure in conduit 308 as compared to pressure in conduit 310 moves piston 300 to the right in the drawings. Likewise, relatively high pressure in conduit 310 as compared to pressure in conduit 308 moves piston 300 to the left in the drawings. Equal pressure on both sides of piston 300 prevents movement of the piston.

Hydraulic high pressure is available at input 318, and relatively lower pressures or returns for hydraulic fluid is provided at inputs 316 and 320. Valve shuttle mechanism 314 is moveable back and forth as indicated by arrow 312. It will be appreciated that many different kinds of commercially available valve mechanisms may be utilized to connect high pressure at input 318 to either side of piston 300.

If actuator 322 moves valve shuttle mechanism 314 to the left, then high pressure at input 318 is connected to hydraulic conduit 310 and low pressure is connected to conduit 308, causing piston 300 and shaft 306 to move to the left, as explained above. Likewise, if actuator 322 moves valve shuttle mechanism 314 to the right, then high pressure at input 318 is connected to hydraulic conduit 308 and low pressure is connected to conduit 310, causing piston 300 and shaft 306 to move to the right. If valve shuttle mechanism is in a center position, then hydraulic pressure on both sides of piston 300 is balanced and movement of the piston is prevented.

Actuator 322 can be operated by motor 324, which is connected by contacts 326 to control systems 10A and 10B, using e.g., connectors 86 and 88 and any desired additional connections or interconnections. In FIG. 9B, solenoids 332 and 330 are utilized to move valve shuttle member 314 as described above. Connectors 342 and 340 are then connected to connectors 86 and 88 along with any desired additional connections, wiring, or interconnections.

Utilizing computing equipment, which is optional but could be utilized, it is possible to compute the angles necessary in an arm with segments of length S3, S2, and B1, to position the end of the arm at a particular x, y position, as indicated in FIG. 10. This is a relatively simple example and three dimensions computations become more complex as the number of links in the arm increases. However, in one preferred embodiment of the invention, an operator can utilize the complex joystick to position an arm in a desired position without the need for calculations.

If a computer is utilized to record motions of the complex joystick, for repetitive actions or the like, computations for this purpose for an x, y position are indicated in FIG. 10.

Angle 210−180 degrees+angle 212+angle 220= arccos $xB1/B1$

Angle 210−180 degrees+angle 212+angle 220= arcsin $yB1/B1$ 180 degrees−angle 212−angle 220=arccos $xS2/S2$ 180 degrees−angle 212−angle 220=arcsin $yS2/S2$ Angle 220=arccos $xS3/S3$ Angle 220=arcsin $yS3/S3$ These equations may be utilized by a computer or calculator to solve for a particular solution.

Likewise, given angles 210, 212, and 220, and lengths S3, S2, and B1, it is possible to calculate a particular x, y position of the end of B1.

$xS3=S3$ cos angle 220

$yS3=S3$ sin angle 220

$xS2=s2$ cos(180 degrees−angle 212−angle 220)

$yS2=s2$ sin(180 degrees−angle 212−angle 220)

$xB1=B1$ cos(angle 210−180 degrees+angle 212+ angle 220)

$yB1=B1$ sin(angle 210−degrees+angle 212+angle 220)

Then x=xS3+xS2+xB1 and y=yS3+yS2+y B1.

FIG. 10B shows one example of the type of shape that a complex joystick with many links may be utilized to create with an arm with a corresponding number of links. The complex joystick could be utilized to follow the above curve or other curves and transfer to the desired shape to the slave unit. These curves may represent differential equations, which can be readily implemented by providing a shape of complex joystick that is replicated in the slave unit.

For example a curve in the shape of $x=dx/dt\ dt+d^2x/dt^2\ dt$ if applied as a shape to the complex joystick would be automatically transferred to the slave unit.

The present invention may be utilized to implement many types of mechanisms besides that of the shown back hoe. A complex joystick may be comprise joints that describe an arm, leg, animal, mule, snake, and the like wherein the lengths of the joystick between joints are preferably in proportion to the lengths between joints of the mechanism or animal or component which is to be controlled by the complex joystick. The invention is not limited to the number of sides in a polygon. Also, the mechanism, as described with respect to swing control 250 shaft 258, the shafts between the joints may twist as desired and effectively simultaneously bend. For example, two circular potentiometers might be positioned within a ball joint of the joystick, or two closely positioned hinged joints, universal connector or the like, and corresponding controlled device to provide that a joints is not hinged for movement of arms within a plane, as is the case of joints 210, 212, and 214 of the back hoe articulated arm but would allow for movement of arms from a joint in any direction.

The invention could aid or automate complex human movements necessary in physical labor; for example, digging ditches, picking vegetables, making three dimensional art (i.e. statutes), building and repairing of roads, etc. The outputs may be recorded and replayed to the servos to effect automatic repetitive operations. The device may be used underground in snaking fashion, perhaps equipped with cameras and lights. Likewise, the invention could produce additional work achieved through greater efficiency allowing for increased economic prosperity for both a local and global environment.

Also, with respect to the back hoe arm, the bucket could be replaced with optional tools including but not limited to that of those typically found in construction (i.e., chisel, jack hammer, hook, or crane, forks, compactor, steam roller, fingers, milling densifier, rock crusher, clam bucket, issues of finishing such as water sprayer, paint gun, sanding, grinding, buffing an the like. Even higher detail applications may be implemented such as cutting, welding, drawing, engraving, surgery, and the like. Buttons or the like may be added to the joystick to effect continuous operations. For example, to operate a jack hammer on the articulated arm to be controlled, at the end of complex joystick, a button or switch may be utilized to start and stop movement of the jack hammer.

The complex joystick may have some friction at the joints and be made of lightweight material so that the joystick position may be held in place after the joystick is released, if desired. Additionally, a laser or electromagnetic position system could be added to limit or double check the operation and/or range of movement.

The back hoe arm might be enhanced by an additional joint that would allow the bucket of the back hoe to rotate or rest on either side. Operation around corners could be effected by rotation of a corresponding joint on the complex joystick.

The use of the present invention could result in an improved or better overall job at a lower cost with a less experienced operator. Operations would be simple and unify multiple actions into one control unit rather than having rows of control levers. The experience and workmanship of a relatively inexperienced operator would be enhanced to perform a superior overall product of work as compared to even a high trained operator using traditional rows of control levers.

It is also to be understood that the foregoing descriptions of preferred embodiments of the invention have been presented for purposes of illustration and explanation and it is not intended to limit the invention to the precise forms disclosed. It is to be appreciated therefore that various structural and circuit changes, many of which are suggested herein, may be made by those skilled in the art without departing from the spirit of the invention.

What is claimed is:

1. A complex joystick control system, comprising:

a complex joystick comprising at least three joystick segments and at least four joystick joints, said at least three joystick segments comprising a plurality of joystick segment lengths having a relative ratio of lengths between themselves, said at least four joystick joints permitting movement of an end of said complex joystick in each of x, y, and z directions with respect to a first fixed position, at least four electronic joystick angle sensors carried by said at least three joystick segments and said at least four joystick joints which produce control signals based on respective relative angular joystick positions of said at least three joystick segments with respect to each other and said first fixed position;

an articulated arm comprising at least three controlled segments and at least four articulated arm joints, said at least three controlled segments comprising a plurality of controlled segment lengths having said relative ratio of lengths between themselves, said at least four articulated arm joints permitting movement of an end of said articulated arm in each of x, y, and z directions with respect to a second fixed position, at least four articulated arm electronic angle sensors carried by said at least three controlled segments and said at least four articulated arm joints which produce control signals based on respective relative angular articulated arm positions of said at least three controlled segments with respect to each other and said second fixed position; and at least four servos which receive signals from respective pairs of said at least four electronic joystick angle sensors and said at least four articulated arm electronic angle sensors, whereby said at least four servos operate to control movement of said articulated arm so that said respective relative angular articulated arm positions of said at least three controlled segments match those of said relative angular joystick positions of said at least three joystick segments.

2. The system of claim 1, wherein said at least four joystick joints comprise hinged joints, said hinged joints comprising at least one joint between a first pair of said joystick segments wherein said first pair of said joystick segments are constrained to move within a first plane relative to each other and at least one joint between another pair of said joystick segments that is constrained to move within a second plane relative to each other wherein said first plane and said second plane are oriented with an angular spacing therebetween.

3. The system of claim 2, wherein said first plane and said second plane are orthogonal with respect to each other.

4. The system of claim 1, wherein said at least four joystick joints comprise at least one joint that allows at least one of said at least three joystick segments to rotate on an axis thereof and a corresponding of said at least four articulated arm joints allows at least one of said at least three controlled segments to rotate on an axis thereof.

5. The system of claim 1, wherein at least one of said at least four servos comprises at least two variable duration pulse generators.

6. The system of claim 1, wherein said articulated arm is used in construction equipment.

7. The system of claim 6, wherein said articulated arm is used in a back hoe.

8. A method of making a complex joystick control system, comprising:

providing a complex joystick with at least three joystick segments and at least three joystick joints;

providing that said at least three joystick segments comprising a plurality of joystick segment lengths having a relative ratio of lengths between themselves providing that said at least three joystick joints permit movement of an end of said complex joystick in each of x, y, and z directions with respect to a first fixed position providing at least three electronic joystick angle sensors positioned at said at least three joints which produce control signals based on respective relative angular joystick positions of said at least three joystick segments with respect to each other and said first fixed position;

providing an articulated arm comprising at least three controlled segments and at least three articulated arm joints;

providing that said at least three controlled segments comprise a plurality of controlled segment lengths having said relative ratio of lengths between themselves;

providing that said at least three articulated arm joints permit movement of an end of said articulated arm in each of x, y, and z directions with respect to a second fixed position;

and providing at least three articulated arm electronic angle sensors positioned at said at least three joints which produce control signals based on respective relative angular articulated arm positions of said at least three controlled segments with respect to each other and said second fixed position; and providing at least three servos which receive signals from respective pairs of said at least three electronic joystick angle sensors and said at least three articulated arm electronic angle sensors, whereby said at least three servos operate to control movement of said articulated arm so that said respective relative angular articulated arm positions of said at least three controlled segments match those of said relative angular joystick positions of said at least three joystick segments.

9. The method of claim 8 wherein said at least three joystick joints comprise hinged joints, said hinged joints comprising at least one joint between a first pair of said joystick segments wherein said first pair of said joystick segments are constrained to move within a first plane relative to each other and at least one joint between another pair of said joystick segments that is constrained to move within a second plane relative to each other wherein said first plane and said second plane are oriented with an angular spacing therebetween.

10. The method of claim 9 wherein said first plane and said second plane are orthogonal with respect to each other.

11. The method of claim 8 wherein said at least three joystick joints comprise at least one joint that allows at least one of said at least three joystick segments to rotate on an axis thereof and a corresponding of said at least three articulated arm joints allows at least one of said at least three controlled segments to rotate on an axis thereof.

12. The method of claim 8 wherein at least one of said at least three servos comprises at least two variable duration pulse generators.

13. A method for operating a complex joystick system comprising at least one complex joystick and at least one articulated arm, wherein said at least one complex joystick and said at least one articulated arm each comprise more than three segments and more than three joints, wherein at least one of said joints rotates at least one segment along an axis thereof, comprising moving an end of said complex joystick to a selected x, y, z position to thereby cause said articulated arm to move to a corresponding x', y', z' position, whereby any x, y, z, position is proportionally related to any x'y, z' position.

14. The method of claim 13 wherein an operator utilizes two complex joysticks to control two articulated arms.

15. The method of claim 13 wherein each of said complex joystick and said articulated arm comprise more than ten segments.

16. The method of claim 13 further comprising operating said complex joystick to catch a moving object.

17. The method of claim 13 further comprising utilizing a mold to place against said complex joystick to thereby replicate a shape of said mold in said articulated arm.

18. The method of claim 13 further comprising utilizing a form to which is applied to said complex joystick to create a sculpture of material in accord with said form.

19. The method of claim 18 wherein said sculpture is much larger than said form.

20. The method of claim 13 further comprising operating said complex joystick to control underground movement of said articulated arm.

* * * * *